United States Patent [19]

Richer

[11] Patent Number: 5,067,286

[45] Date of Patent: Nov. 26, 1991

[54] PLANTER

[76] Inventor: Raymond P. Richer, 872 Lochness Crescent, Oshawa, Ontario, Canada, L1J 7P8

[21] Appl. No.: 479,426

[22] Filed: Feb. 13, 1990

[30] Foreign Application Priority Data

Feb. 13, 1990 [CA] Canada ..... 590910

[51] Int. Cl.[5] ..... A47G 7/02

[52] U.S. Cl. ..... 52/27; 47/66

[58] Field of Search ..... 52/27, 34; 47/66, 68; 220/256

[56] References Cited

U.S. PATENT DOCUMENTS

| | | | |
|---|---|---|---|
| 1,239,076 | 9/1917 | Baker | 52/27 |
| 1,751,851 | 5/1929 | Bennett | 47/68 |
| 3,698,143 | 10/1972 | Francis | 47/68 |

FOREIGN PATENT DOCUMENTS 45595 6/1979 Canada .

*Primary Examiner*—David A. Scherbel

*Assistant Examiner*—Michele A. Van Patten

[57] ABSTRACT

The present invention provides for a planter for mounting within an existing hollow wall cavity such that it gives the aesthetically pleasing appearance of the plant growing out of the wall. The planter comprises a generally rectangular front port opening into a plant display portion having a downwardly sloped rear wall such that said display portion rapidly decreases in size from said front port to a point of maximum depth of said display portion. A downwardly tapered soil holding portion of a height greater than the height of said front port is located below and within the depth of said plant display portion. The downwardly sloped rear wall of said display portion and said tapered soil holding portion being of a shape and cooperating to accommodate insertion of said planter through an opening in a wall generally corresponding to the front port with a clearance behind the wall generally equal to the maximum depth of said display portion. In an aspect of the invention, a frame is provided contained within the port of the planter and extending outwardly from the port. The frame may be integrally formed with the port.

10 Claims, 5 Drawing Sheets

PLANTER

BACKGROUND OF THE INVENTION

The present invention relates to a novel container for plants and more particularly, to a planter for use within an existing hollow wall cavity.

BRIEF DESCRIPTION OF THE PRIOR ART

It has been found that attaching planters to a wall, especially those containing plants which grow in a cascade such as ivy, spider plants, etc. results in an aesthetically pleasing appearance giving the illusion of the plant growing from the wall. Prior to the present invention, a number of containers for plants have been known including, amongst others, boxes, pots, etc. Generally if one wished to mount such planters to provide for a hanging plant giving the illusion of the plant growing from the wall, the planters were either mounted in a basket hanging from a bracket attached to the wall or attached directly to the wall.

In order to improve the illusion of the plant growing from the wall, planters for installation within a hollow wall cavity have been developed. Such a planter is exemplified by Canadian Industrial Design No. 45,595 owned by the inventor of the present application. However, this prior planter was designed primarily for use in new construction where the planter could be mounted within a wall cavity and the wall finishing material thereafter attached to the wall. In the case of existing walls, should one have wished to utilize the prior known planter, it was necessary to make a hole in the wall large enough to pass the entire planter through, mount the planter, then repair the hole. It was thus not easy to install the prior art planter in existing walls nor was the planter easily removed once installed. Consequently, there still remains a need for a planter which is easily installed in an existing wall and provides for an aesthetically pleasing appearance.

SUMMARY OF THE INVENTION

The present invention provides for a planter for mounting within an existing hollow wall cavity such that it gives the aesthetically pleasing appearance of the plant growing out of the wall. The planter comprises a generally rectangular front port opening into a plant display portion having a downwardly sloped rear wall such that said display portion rapidly decreases in size from said front port to a point of maximum depth of said display portion. A downwardly tapered soil holding portion of a height greater than the height of said front port is located below and within the depth of said plant display portion. The downwardly sloped rear wall of said display portion and said tapered soil holding portion being of a shape and cooperating to accommodate insertion of said planter through an opening in a wall generally corresponding to the front port with a clearance behind the wall generally equal to the maximum depth of said display portion.

In an aspect of the invention, a frame is provided contained within the port of the planter and extending outwardly from the port.

In yet another aspect of the invention, the frame is integrally formed with the port.

BRIEF DESCRIPTION OF THE DRAWINGS

In drawings which illustrate preferred embodiments of the invention.

DESCRIPTION OF THE PREFERRED EMBODIMENTS

Figure 1:
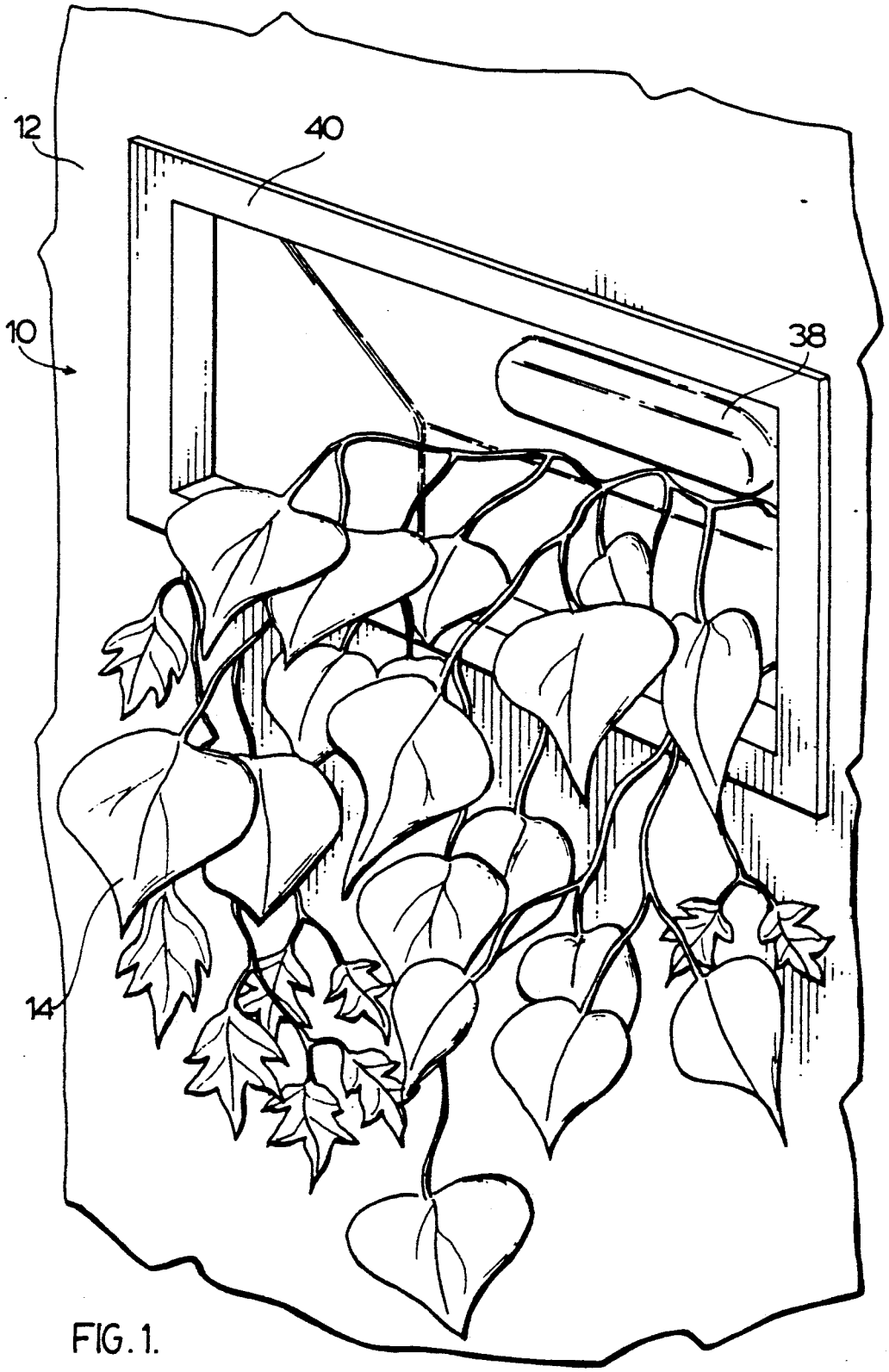
FIG. 1 is a perspective view of one embodiment of a planter of the present invention, mounted within a wall cavity.
Figure 2:
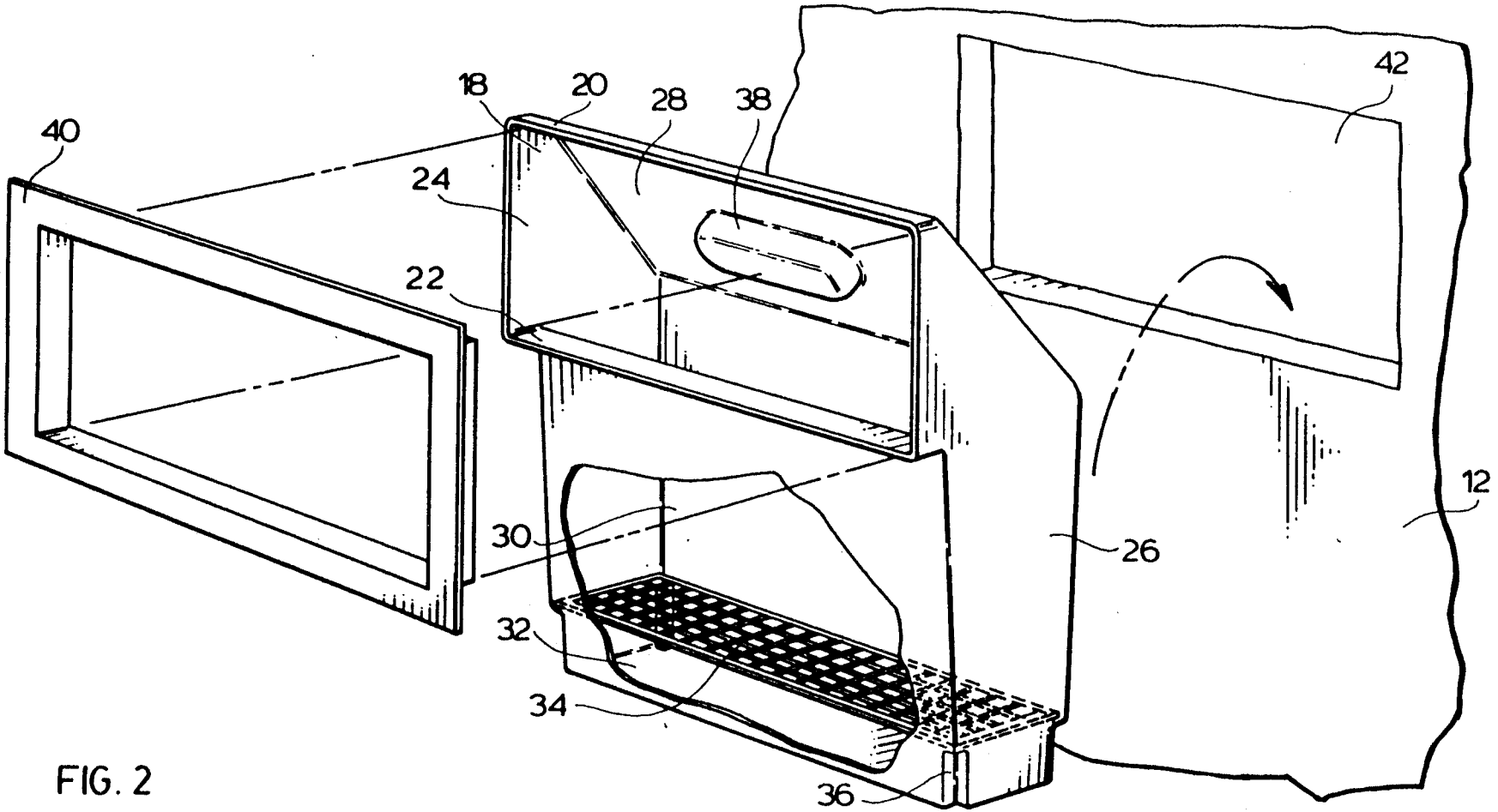
FIG. 2 is an exploded perspective view partly in section of the planter of FIG. 1.
Figure 3:
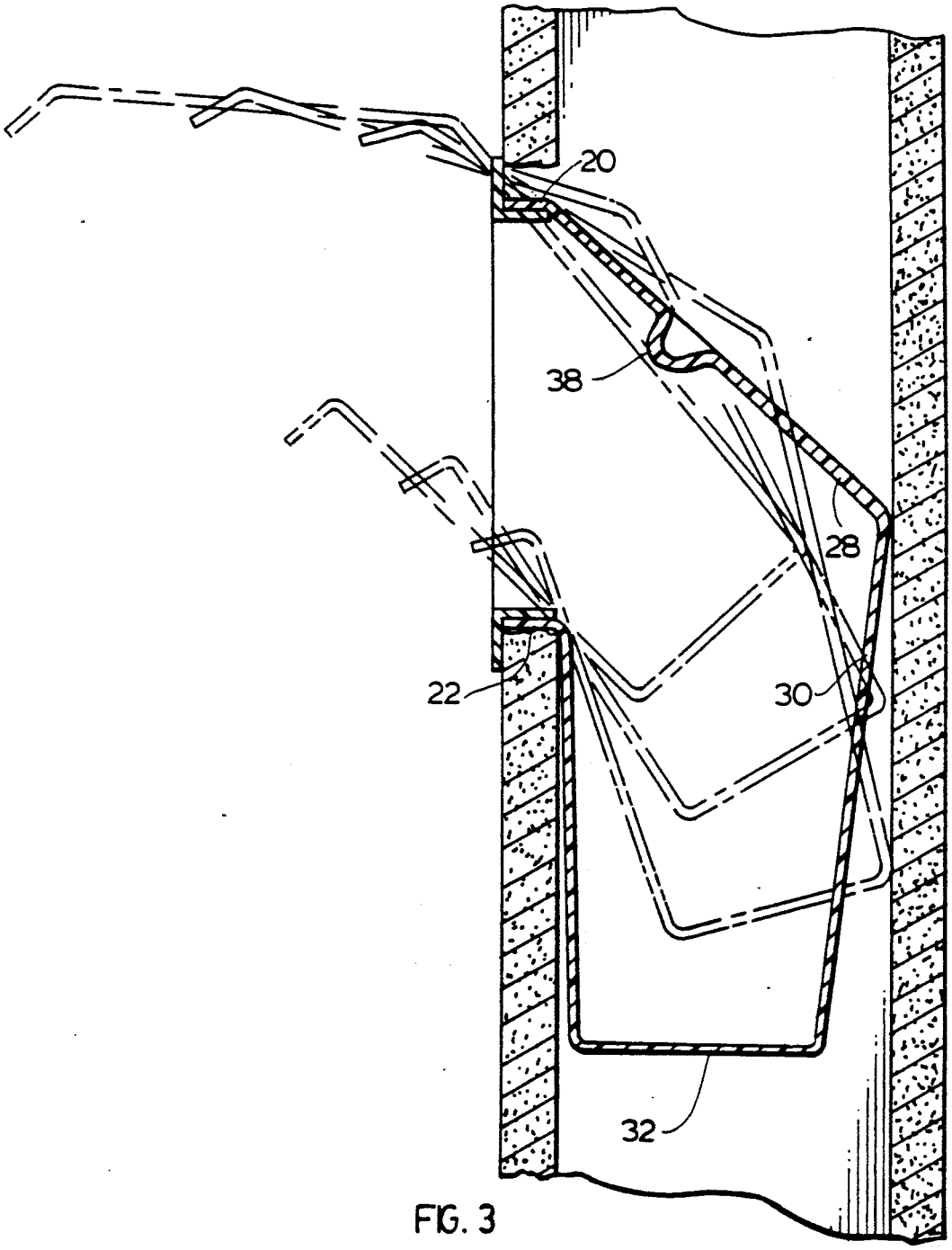
FIG. 3 is a perspective view of the planter of FIG. 1 in the process of being mounted within the wall.
Figure 4:
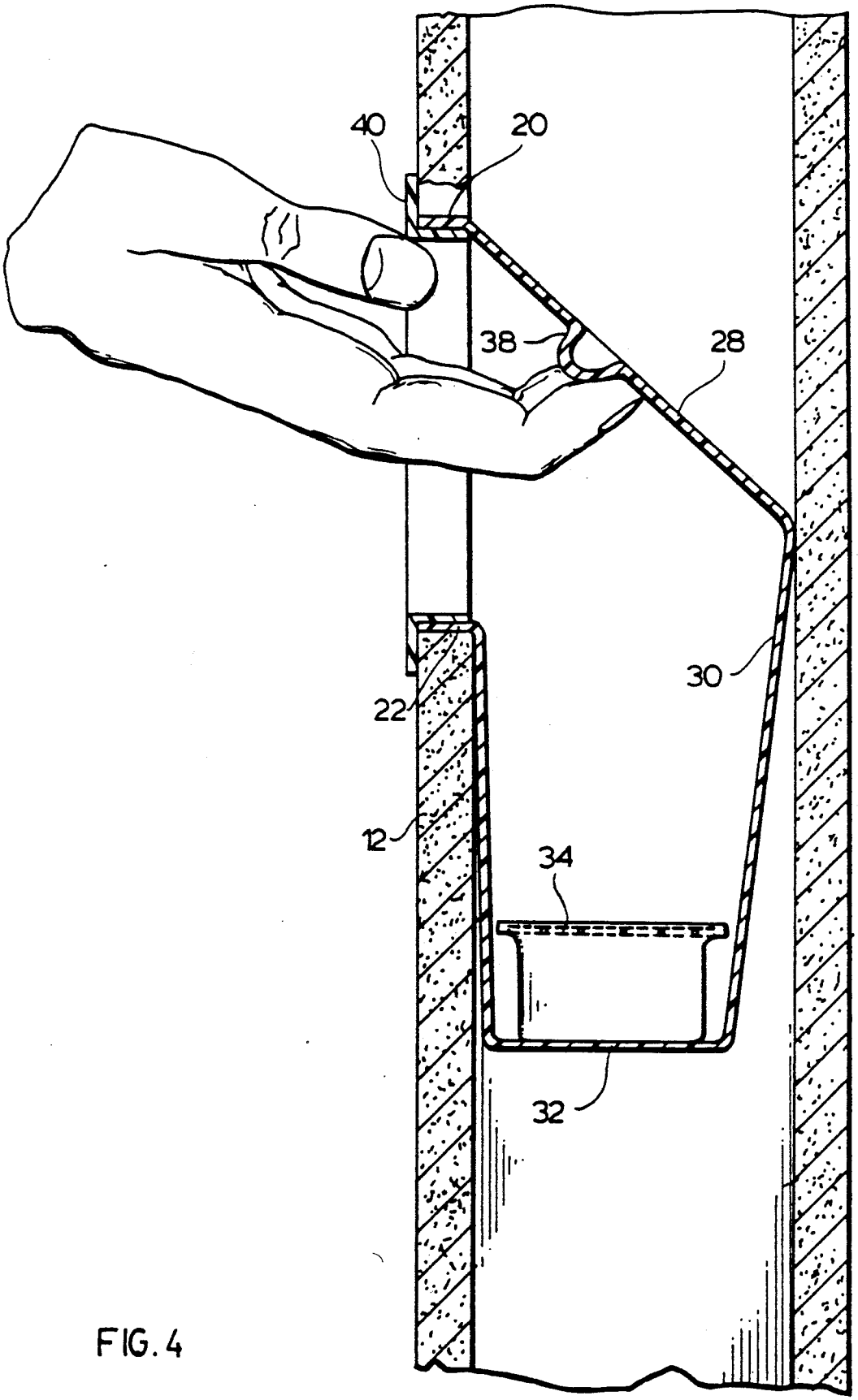
FIG. 4 is a cross-section of the planter of FIG. 1 mounted within the wall.

Referring now to FIG. 1 of the drawings, there is shown, generally represented by the numeral 10, a preferred embodiment of a planter of the present invention. The planter is shown mounted within a wall cavity defined by a first wall covering material 12 and a second wall covering material 50 (not shown in FIG. 1). Growing from the planter 10 and giving the impression of growing from the wall is a plant 14. The details of the planter 10 are shown more fully in FIG. 2. The planter 10 has an upper plant display portion with a forwardly extending port 18, which in the preferred embodiment is a rectangular like aperture. The periphery of the port 18 is defined by a narrow upper lip 20, a narrow lower lip 22 and side walls 24 and 26 which extend from the sides of a lower, soil containing portion of the planter 10. The upper display portion of the planter 10 further has a rear wall 28 sloping downwardly from the upper lip 20 of the port 18. The lower, soil containing portion of the planter has a rear wall 30 sloping downwardly and inwardly from the rear wall 28 of the upper display portion to join a generally rectangular bottom 32. The junction between rear wall 28 and rear wall 30 is termed the transition point and is the point of maximum depth of the planter 10.

It is sometimes preferable to provide for a small air space at the bottom of the soil containing portion of the planter 10 and this is provided for in the preferred embodiment of the present invention by a mesh or grid 34 in the interior of the planter 10. This grid 34 is supported away from the bottom 32 on indentations 36 formed in the corners of the planter. The planter 10 in the rear wall 28 of the upper display portion also preferably has a handle 38 which aids in installation and removal of the planter 10.

The planter 10 may also include a frame 40 which can be mounted in the port 18 of the planter and overlay the opening 42 in the wall covering material 12. This results in a more finished appearance to the planter once it is mounted in the wall cavity.

To mount the planter in the wall, an opening 42 is cut within the wall covering 12. The size of the opening 42 is easily determined by using the the dimensions of the outside of the port 18 of the planter 10 as a guide. Once the opening 42 is cut in the wall, the lower soil containing portion of the planter is fed by first downwardly inserting the soil containing portion through the opening 42 with the lower rear wall 30 and lower front wall being generally in close proximity to the top and bottom of the opening respectively until the lower rear wall 30 clears the opening 42 and the transition point passes through the opening. Thereafter the lower front wall cooperates with the top rear wall 28 to accommodate rotation of the planter 10 generally about the bottom edge of the opening 42 and continued downward insertion until the port 18 is aligned with the opening 42 in the first wall covering material 12 and the transition point is in contact with the second wall covering material 50. At this point, the transition point between the upper rear wall 28 and the lower rear wall 30 rests against the second wall covering 50 defining the back of the wall cavity and in co-operation with the periphery of the port 18 contained within the opening 42 securely holds the planter 10 within the wall cavity. For additional support the planter 10 may be designed such that when it is mounted within the wall cavity, the front of the lower soil containing portion rests against the inside of the first wall covering 12.

Once the planter 10 has been installed within the wall cavity, the frame 40 is easily placed within the port 18 and overlays the rough edges of the wall opening 42 thereby providing a finished appearance to the planter 10. The planter 10 may then be filled with suitable material to support plant growth such as potting soil or the like and the plant 14 installed within the planter. In this way, the planter 10 provides for the illusion of a plant growing out of the wall and gives a very aesthetically pleasing appearance.

Figure 5:
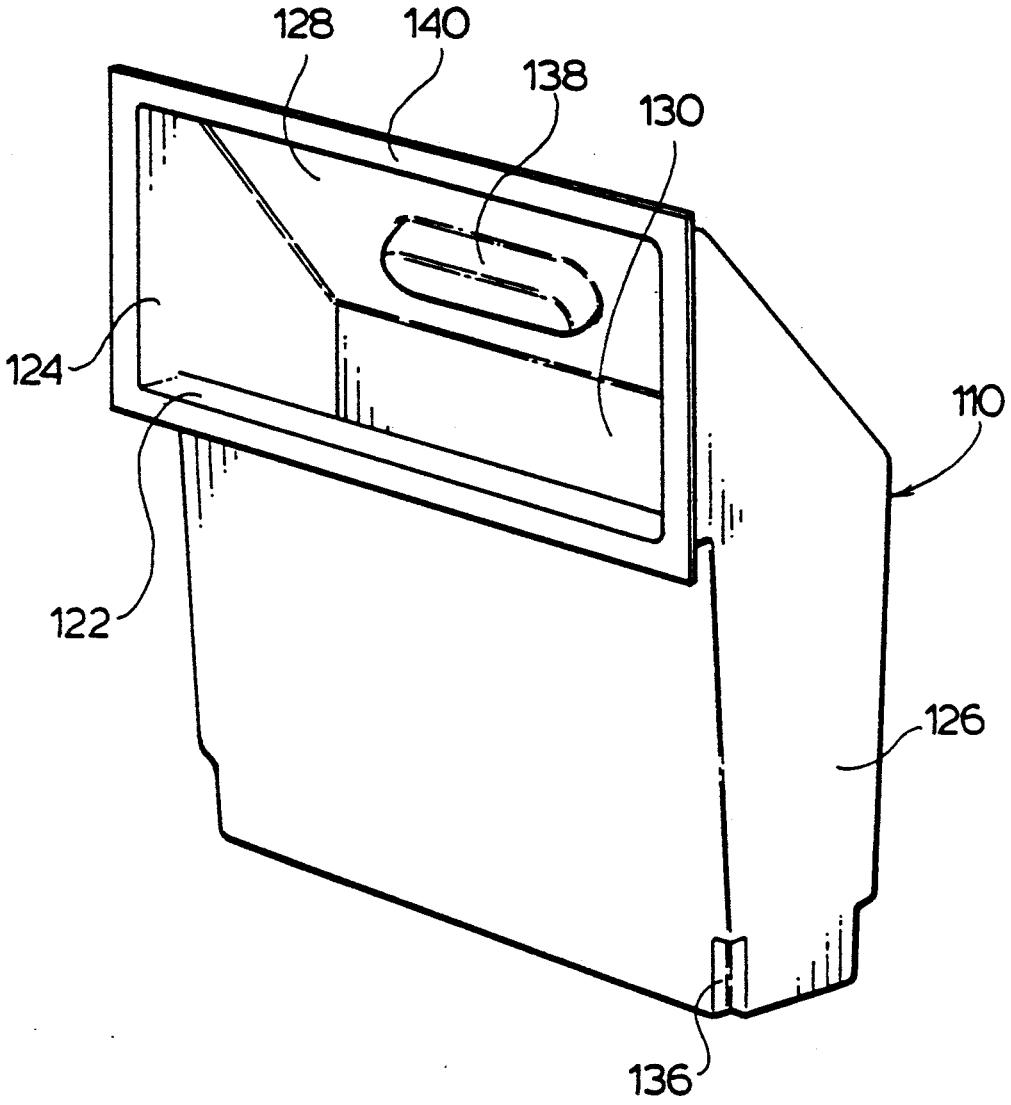
FIG. 5 is a perspective view of a second embodiment of a planter of the present invention.

Referring now to FIG. 5 of the drawings, there is shown, generally represented by the numeral 110, a second embodiment of a planter of the present invention. The planter 110 also has an upper plant display portion with a forwardly extending port 118, defined by a narrow upper lip 120, a narrow lower lip 122 and side walls 124 and 126 which extend from the sides of a lower, soil containing portion of the planter 110. The upper display portion of the planter 110 further has a rear wall 128 sloping downwardly from the upper lip 120 of the port 118. The lower, soil containing portion of the planter has a rear wall 130 sloping downwardly and inwardly from the rear wall 128 of the upper display portion to join a generally rectangular bottom 132. The planter 110 also includes a frame 140 which is integral with the port 118 of the planter and which, when the planter is mounted within the wall, will overlay the opening 42 in the wall covering material 12. This results in a more finished appearance to the planter and provides for an additional support point for the planter once mounted in the wall cavity.

The planter of the present invention can be used with any size of hollow wall cavity, the most common of which have depths of 3.5 inches or 5.5 inches depending upon the size of stud used to construct the wall. The selection of the size of the planter is determined by the depth of the hollow wall cavity and the height of the opening. Once these have been determined, the various dimensions of the planter are easily determined using standard geometry in conjunction with the teaching of the operation of the planter contained herein. The planter 110 of the second embodiment, having the integral frame 140, is useable with wall cavities of varying depth as the integral frame in cooperation with the front wall of the lower soil containing portion, provides support in wall cavities where the transition point may not be in intimate contact with the second wall covering.

The planter can be constructed of any material which is easily formable to the desired shape and is inert with respect to possible effects upon plants. Preferably the planter is constructed of a plastic material through molding, either blow molding or injection molding of a suitable polymer material. Most preferably the planter is constructed by injection molding a thermosetting polymer such as, for example, polyethylene or polypropylene. By injection molding using such polymers, dyes may be incorporated during the molding process to produce planters of various colors which will coordinate with the wall color, thereby increasing the esthetic effect achieved by the planter.

As the planter 10 or 110 owing to its design, is securely held within the wall cavity, it is usually not necessary to permanently affix the planter in any way to the wall covering or the wall support. Should it therefore be desired to remove the planter from the wall cavity, this is very easily accomplished by reaching in, grasping the handle 38 or 138 and pulling the planter 10 or 110 out of the wall cavity.

Although various preferred embodiments of the present invention have been described herein in detail, it will be appreciated by those skilled in the art that variations may be made thereto without departing from the spirit of the invention or the scope of the appended claims.

The embodiments of the invention in which an exclusive property or privilege is claimed are defined as follows:

1. A planter for mounting within a wall comprising a generally rectangular front port opening into a plant display portion having a downwardly sloped rear wall such that said display portion rapidly decreases in size from said front port to a point of maximum depth of said display portion, and a downwardly tapered soil holding portion of a height greater than the height of said front port, said soil holding portion being located below said front port and located below and within the depth of said plant display portion, said downwardly sloped rear wall of said display portion and said tapered soil holding portion being of a shape and cooperating to accommodate insertion of said planter through an aperture in a wall generally corresponding to the front port with a clearance behind the wall generally equal to the maximum depth of said display portion.

2. A planter as claimed in claim 1, wherein said downwardly tapered soil holding portion includes a generally planar rear wall angled towards the plane of said front port such that the bottom of the soil holding portion is substantially inset from the point of maximum depth of said plant display portion.

3. A planter as claimed in claim 1, wherein said soil holding portion is of a height about one and a quarter to two times the height of the height of said front port and tapers to a bottom portion generally less than half the maximum depth of said plant display portion.

4. A planter as claimed in claim 1, 2 or 3, wherein said point of maximum depth of said plant display portion is within the height of said front port.

5. A planter as claimed in claim 1, 2 or 3, further comprising a frame contained within said port of said planter and extending outwardly from said port.

6. A planter as claimed in claim 1, 2 or 3, further comprising a frame contained within said port of said planter, extending outwardly from said port and integral therewith.

7. In combination, a hollow wall cavity being defined by a first wall covering material and a second wall covering material, said first wall covering material having a generally rectangular opening therein and a planter supported within said hollow wall cavity; said planter comprising an upper plant display portion having a forwardly extending generally rectangular port generally aligned with and contained within said opening, a top extending generally rearwardly and downwardly from said port to a support point in contact with said second wall covering material and a lower soil holding portion having an inwardly tapering back wall and having a height greater than the height of said opening and said soil holding portion being located behind said opening, said planter being supported within said hollow wall cavity by the cooperation of said port being contained within said opening of said first wall covering material and said support point contacting said second wall covering material.

8. The planter and wall combination as claimed in claim 7 further comprising a frame contained within said port of said planter and extending outwardly from said port.

9. The planter and wall combination as claimed in claim 8 wherein said frame is integrally formed with said port.

10. A planter adapted to be inserted through a generally rectangular opening in a first of two generally planar members defining a channel therebetween, said planter comprising an upper front portion having a port generally corresponding in size and shape to the size and shape of said opening; a top rear wall extending rearwardly and downwardly from said port to a transition point, the distance between the front of said port and said transition point defining the maximum depth of said planter relative to the plane of said port and a lower soil holding portion having a lower front wall extending downwardly from said aperture said lower front wall having a height greater than the height of said port a lower back wall extending downwardly and inwardly from said transition point and a bottom of a depth significantly less than the maximum depth of said planter; said lower rear wall cooperating with said lower front wall and said transition point to accommodate feeding of said planter through the opening by first downwardly inserting said soil holding portion through the opening with the lower rear wall and lower front wall being generally in close proximity to the top and bottom of the opening respectively until said lower rear wall clears said opening with said transition point passing through said opening whereafter said lower front wall cooperates with said top rear wall to accommodate rotation of the planter generally about the bottom edge of the opening and continued downward insertion until the port is aligned with the opening in the first planar member and said transition point is in contact with the second planar member.

* * * * *